US010330382B2

(12) United States Patent
Mak et al.

(10) Patent No.: US 10,330,382 B2
(45) Date of Patent: Jun. 25, 2019

(54) SYSTEMS AND METHODS FOR LNG PRODUCTION WITH PROPANE AND ETHANE RECOVERY

(71) Applicant: Fluor Technologies Corporation, Sugar Land, TX (US)

(72) Inventors: John Mak, Santa Ana, CA (US); Jacob Thomas, Sugar Land, TX (US); Curt Graham, Mission Viejo, CA (US)

(73) Assignee: Fluor Technologies Corporation, Sugar Land, TX (US)

( * ) Notice: Subject to any disclaimer, the term of this patent is extended or adjusted under 35 U.S.C. 154(b) by 0 days.

(21) Appl. No.: 15/158,143

(22) Filed: May 18, 2016

(65) Prior Publication Data

US 2017/0336137 A1 Nov. 23, 2017

(51) Int. Cl.

| | |
|---|---|
| ***F25J 1/02*** | (2006.01) |
| ***F25J 1/00*** | (2006.01) |
| ***F25J 3/02*** | (2006.01) |

(52) U.S. Cl.

CPC ..... *F25J 1/0228* (2013.01); *F25J 1/004* (2013.01); *F25J 1/0022* (2013.01); *F25J 1/0035* (2013.01); *F25J 1/0052* (2013.01); *F25J 1/0055* (2013.01); *F25J 1/0212* (2013.01); *F25J 1/0216* (2013.01); *F25J 1/0239* (2013.01); *F25J 1/0291* (2013.01); *F25J 3/0209* (2013.01); *F25J 3/0233* (2013.01); *F25J 3/0238* (2013.01); *F25J 3/0242* (2013.01); *F25J 2200/02* (2013.01);

(Continued)

(58) Field of Classification Search

CPC ..... F25J 3/0233; F25J 3/0238; F25J 3/0242

See application file for complete search history.

(56) References Cited

U.S. PATENT DOCUMENTS

| | | | |
|---|---|---|---|
| 2,603,310 | A | 7/1952 | Gilmore et al. |
| 2,771,149 | A | 11/1956 | Miller et al. |

(Continued)

FOREIGN PATENT DOCUMENTS

| | | |
|---|---|---|
| AR | 103703 | 5/2017 |
| AT | 383557 T | 1/2010 |

(Continued)

OTHER PUBLICATIONS

English translation of DE 102009004109 A1 provided by Espacenet. Oct. 2017.*

(Continued)

*Primary Examiner* — Tareq Alosh

(74) *Attorney, Agent, or Firm* — Conley Rose, PC

(57) ABSTRACT

A LNG liquefaction plant includes a propane recovery unit including an inlet for a feed gas, a first outlet for a LPG, and a second outlet for an ethane-rich feed gas, an ethane recovery unit including an inlet coupled to the second outlet for the ethane-rich feed gas, a first outlet for an ethane liquid, and a second outlet for a methane-rich feed gas, and a LNG liquefaction unit including an inlet coupled to the second outlet for the methane-rich feed gas, a refrigerant to cool the methane-rich feed gas, and an outlet for a LNG. The LNG plant may also include a stripper, an absorber, and a separator configured to separate the feed gas into a stripper liquid and an absorber vapor. The stripper liquid can be converted to an overhead stream used as a reflux stream to the absorber.

20 Claims, 5 Drawing Sheets

(52) U.S. Cl.
CPC ..... *F25J 2200/04* (2013.01); *F25J 2200/08* (2013.01); *F25J 2200/70* (2013.01); *F25J 2200/76* (2013.01); *F25J 2200/78* (2013.01); *F25J 2205/50* (2013.01); *F25J 2210/06* (2013.01); *F25J 2215/04* (2013.01); *F25J 2215/60* (2013.01); *F25J 2215/62* (2013.01); *F25J 2215/64* (2013.01); *F25J 2230/30* (2013.01); *F25J 2230/60* (2013.01); *F25J 2235/60* (2013.01); *F25J 2240/02* (2013.01); *F25J 2260/20* (2013.01); *F25J 2270/12* (2013.01); *F25J 2270/18* (2013.01); *F25J 2270/60* (2013.01); *F25J 2270/66* (2013.01)

(56) References Cited

U.S. PATENT DOCUMENTS 3,421,610 A 1/1969 Marshall et al.
3,421,984 A 1/1969 Jensen et al.
3,793,157 A 2/1974 Hobbs et al.
4,004,430 A 1/1977 Solomon et al.
4,061,481 A 12/1977 Campbell et al.
4,102,659 A 7/1978 Martin
4,157,904 A 6/1979 Campbell et al.
4,164,452 A 8/1979 Funk et al.
4,203,742 A 5/1980 Agnihotri
4,278,457 A 7/1981 Campbell et al.
4,474,591 A 10/1984 Arand et al.
4,496,380 A 1/1985 Harryman
4,507,133 A 3/1985 Khan et al.
4,509,967 A 4/1985 Sweet
4,519,824 A 5/1985 Huebel
4,617,039 A 10/1986 Buck
4,657,571 A 4/1987 Gazzi
4,676,812 A 6/1987 Kummann
4,695,349 A 9/1987 Becker et al.
4,854,955 A 8/1989 Campbell et al.
RE33,408 E 10/1990 Khan et al.
5,220,797 A 6/1993 Krishnamurthy et al.
5,291,736 A 3/1994 Paradowski
5,555,748 A 9/1996 Campbell et al.
5,657,643 A * 8/1997 Price ..... F25B 1/10 62/612
5,669,238 A 9/1997 Devers
5,685,170 A 11/1997 Sorensen
5,687,584 A 11/1997 Mehra
5,746,066 A 5/1998 Manley
5,771,712 A 6/1998 Campbell et al.
5,881,569 A 3/1999 Campbell et al.
5,890,377 A 4/1999 Foglietta
5,890,378 A 4/1999 Rambo et al.
5,953,935 A 9/1999 Sorensen
5,983,664 A 11/1999 Campbell et al.
5,992,175 A 11/1999 Yao et al.
6,006,546 A 12/1999 Espie
6,112,549 A 9/2000 Yao et al.
6,116,050 A * 9/2000 Yao ..... F25J 3/0209 62/630
6,116,051 A 9/2000 Agrawal et al.
6,125,653 A 10/2000 Shu et al.
6,182,469 B1 2/2001 Campbell et al.
6,244,070 B1 6/2001 Lee et al.
6,308,532 B1 10/2001 Hopewell
6,311,516 B1 * 11/2001 Key ..... F25J 3/0209 62/619
6,336,344 B1 1/2002 O'Brien
6,354,105 B1 3/2002 Lee et al.
6,363,744 B2 4/2002 Finn et al.
6,368,385 B1 4/2002 Paradowski
6,401,486 B1 6/2002 Lee et al.
6,405,561 B1 6/2002 Mortko et al.
6,453,698 B2 9/2002 Jain et al.
6,516,631 B1 2/2003 Trebble
6,601,406 B1 8/2003 Deng et al.
6,658,893 B1 12/2003 Mealey
6,712,880 B2 3/2004 Foglietta et al.
6,755,965 B2 6/2004 Pironti et al.
6,823,692 B1 11/2004 Patel et al.
6,837,070 B2 1/2005 Mak
6,915,662 B2 7/2005 Wilkinson et al.
7,051,552 B2 5/2006 Mak
7,051,553 B2 5/2006 Mak et al.
7,069,744 B2 7/2006 Patel et al.
7,073,350 B2 7/2006 Mak
7,107,788 B2 9/2006 Patel et al.
7,159,417 B2 1/2007 Foglietta et al.
7,192,468 B2 3/2007 Mak et al.
7,216,507 B2 5/2007 Cuellar et al.
7,377,127 B2 5/2008 Mak
7,424,808 B2 9/2008 Mak
7,437,891 B2 10/2008 Reyneke et al.
7,574,856 B2 8/2009 Mak
7,597,746 B2 10/2009 Mak et al.
7,600,396 B2 10/2009 Mak
7,635,408 B2 12/2009 Mak et al.
7,637,987 B2 12/2009 Mak
7,674,444 B2 3/2010 Mak
7,713,497 B2 5/2010 Mak
7,856,847 B2 12/2010 Patel et al.
7,856,848 B2 12/2010 Lu
8,110,023 B2 2/2012 Mak et al.
8,117,852 B2 2/2012 Mak
8,142,648 B2 3/2012 Mak
8,147,787 B2 4/2012 Mak et al.
8,192,588 B2 6/2012 Mak
8,196,413 B2 6/2012 Mak
8,209,996 B2 7/2012 Mak
8,316,665 B2 11/2012 Mak
8,377,403 B2 2/2013 Mak
8,398,748 B2 3/2013 Mak
8,480,982 B2 7/2013 Mak et al.
8,505,312 B2 8/2013 Mak et al.
8,528,361 B2 9/2013 Nanda et al.
8,567,213 B2 10/2013 Mak
8,635,885 B2 1/2014 Mak
8,661,820 B2 3/2014 Mak
8,677,780 B2 3/2014 Mak
8,695,376 B2 4/2014 Mak
8,696,798 B2 4/2014 Mak
8,840,707 B2 9/2014 Mak
8,845,788 B2 9/2014 Mak
8,876,951 B2 11/2014 Mak
8,893,515 B2 11/2014 Mak
8,910,495 B2 12/2014 Mak
8,919,148 B2 12/2014 Wilkinson et al.
8,950,196 B2 2/2015 Mak
9,103,585 B2 8/2015 Mak
9,114,351 B2 8/2015 Mak
9,132,379 B2 9/2015 Mak
9,248,398 B2 2/2016 Mak
9,423,175 B2 8/2016 Mak
9,557,103 B2 1/2017 Mak
10,006,701 B2 6/2018 Mak
2002/0042550 A1 4/2002 Pironti et al.
2003/0005722 A1 * 1/2003 Wilkinson ..... F25J 1/0205 62/613
2004/0148964 A1 8/2004 Patel et al.
2004/0159122 A1 8/2004 Patel et al.
2004/0172967 A1 9/2004 Patel et al.
2004/0206112 A1 10/2004 Mak
2004/0250569 A1 12/2004 Mak
2004/0261452 A1 12/2004 Mak et al.
2005/0247078 A1 11/2005 Wilkinson et al.
2005/0255012 A1 11/2005 Mak
2005/0268649 A1 12/2005 Wilkinson et al.
2006/0021379 A1 2/2006 Ronczy
2006/0032269 A1 2/2006 Cuellar et al.
2006/0221379 A1 10/2006 Noda
2006/0260355 A1 11/2006 Roberts et al.
2006/0283207 A1 12/2006 Pitman et al.
2007/0240450 A1 10/2007 Mak
2008/0016909 A1 1/2008 Lu
2008/0271480 A1 11/2008 Mak
2009/0100862 A1 4/2009 Wilkinson et al.

(56) References Cited

U.S. PATENT DOCUMENTS

| | | | | |
|---|---|---|---|---|
| 2009/0113931 | A1 | 5/2009 | Patel et al. | |
| 2009/0277217 | A1 | 11/2009 | Ransbarger et al. | |
| 2010/0000255 | A1 | 1/2010 | Mak | |
| 2010/0011809 | A1 | 1/2010 | Mak | |
| 2010/0011810 | A1 | 1/2010 | Mak et al. | |
| 2010/0043488 | A1 | 2/2010 | Mak et al. | |
| 2010/0126187 | A1 | 5/2010 | Mak | |
| 2010/0206003 | A1 | 8/2010 | Mak | |
| 2010/0275647 | A1 | 11/2010 | Johnke et al. | |
| 2010/0287984 | A1 | 11/2010 | Johnke et al. | |
| 2011/0067442 | A1 | 3/2011 | Martinez et al. | |
| 2011/0174017 | A1 | 7/2011 | Victory et al. | |
| 2011/0265511 | A1 | 11/2011 | Fischer et al. | |
| 2012/0000245 | A1 | 1/2012 | Currence et al. | |
| 2012/0036890 | A1 | 2/2012 | Kimble et al. | |
| 2012/0085127 | A1 | 4/2012 | Nanda et al. | |
| 2012/0096896 | A1 | 4/2012 | Patel et al. | |
| 2012/0137726 | A1 | 6/2012 | Currence et al. | |
| 2013/0061632 | A1 | 3/2013 | Brostow et al. | |
| 2013/0061633 | A1 | 3/2013 | Mak et al. | |
| 2013/0186133 | A1 | 7/2013 | Ploeger et al. | |
| 2014/0026615 | A1* | 1/2014 | Mak | C10L 3/10 62/620 |
| 2014/0182331 | A1* | 7/2014 | Burmberger | F25J 1/0022 62/630 |
| 2014/0260420 | A1 | 9/2014 | Mak | |
| 2015/0184931 | A1 | 7/2015 | Mak | |
| 2015/0322350 | A1 | 11/2015 | Iyer et al. | |
| 2016/0231052 | A1 | 8/2016 | Mak | |
| 2017/0051970 | A1 | 2/2017 | Mak | |
| 2017/0370641 | A1 | 12/2017 | Mak et al. | |
| 2018/0266760 | A1 | 9/2018 | Mak et al. | |

FOREIGN PATENT DOCUMENTS

| | | | | |
|---|---|---|---|---|
| AU | 2002303849 | A1 | 12/2003 | |
| AU | 2008287322 | A1 | 2/2009 | |
| AU | 2011349713 | A1 | 7/2013 | |
| CA | 2484085 | A1 | 12/2003 | |
| CA | 2694149 | A1 | 2/2009 | |
| CA | 2976071 | | 8/2017 | |
| CN | 101815915 | A | 8/2010 | |
| DE | 60224585 | T2 | 4/2009 | |
| DE | 102009004109 | A1 * | 7/2010 | F25J 1/0212 |
| EA | 201390957 | A1 | 12/2013 | |
| EP | 0010939 | A1 | 5/1980 | |
| EP | 1508010 | A1 | 2/2005 | |
| EP | 2185878 | A1 | 5/2010 | |
| EP | 2655992 | A1 | 10/2013 | |
| EP | 2521761 | B1 | 11/2015 | |
| EP | 3256550 | A1 | 12/2017 | |
| GC | 0004114 | | 4/2016 | |
| JP | 2007510124 | A | 4/2007 | |
| MX | 2010001472 | A | 3/2010 | |
| MX | 2013007136 | A | 8/2013 | |
| NO | 20044580 | A | 12/2004 | |
| WO | WO99023428 | A1 | 5/1999 | |
| WO | WO0188447 | A1 | 11/2001 | |
| WO | WO2002014763 | A1 | 2/2002 | |
| WO | WO2003095913 | A1 | 11/2003 | |
| WO | WO2003100334 | A1 | 12/2003 | |
| WO | WO2004017002 | A1 | 2/2004 | |
| WO | WO2004065868 | A2 | 8/2004 | |
| WO | WO2004076946 | A2 | 9/2004 | |
| WO | WO2004080936 | A1 | 9/2004 | |
| WO | WO2005045338 | A1 | 5/2005 | |
| WO | WO2007001669 | A2 | 1/2007 | |
| WO | WO2007014069 | A2 | 2/2007 | |
| WO | WO2007014209 | A2 | 2/2007 | |
| WO | WO2008002592 | A2 | 1/2008 | |
| WO | WO2009023252 | A1 | 2/2009 | |
| WO | WO2012087740 | A1 | 6/2012 | |
| WO | WO2012177749 | A2 | 12/2012 | |
| WO | WO2014047464 | A1 | 3/2014 | |
| WO | WO2014151908 | A1 | 9/2014 | |
| WO | WO2016130574 | A1 | 8/2016 | |
| WO | WO2017119913 | A1 | 7/2017 | |
| WO | WO2017200557 | A1 | 11/2017 | |
| WO | 2018049128 | A1 | 3/2018 | |

OTHER PUBLICATIONS

PCT Application No. PCT/US2016/034362, International Search Report, dated Dec. 8, 2016, 6 pages.

PCT Application No. PCT/US2016/034362, Written Opinion of the International Searching Authority, dated Dec. 8, 2016, 6 pages.

Restriction Requirement dated Nov. 19, 2015, U.S. Appl. No. 14/033,096, filed Sep. 20, 2013.

Office Action dated Jun. 2, 2016, U.S. Appl. No. 14/033,096, filed Sep. 20, 2013.

Final Office Action dated Dec. 9, 2016, U.S. Appl. No. 14/033,096, filed Sep. 20, 2013.

Advisory Action dated Feb. 28, 2017, U.S. Appl. No. 14/033,096, filed Sep. 20, 2013.

Office Action dated May 11, 2017, U.S. Appl. No. 14/033,096, filed Sep. 20, 2013.

Final Office Action dated Nov. 15, 2017, U.S. Appl. No. 14/033,096, filed Sep. 20, 2013.

Advisory Action dated Feb. 6, 2018, U.S. Appl. No. 14/033,096, filed Sep. 20, 2013.

Office Action dated Mar. 26, 2018, U.S. Appl. No. 14/033,096, filed Sep. 20, 2013.

Office Action dated Nov. 25, 2015, U.S. Appl. No. 14/210,061, filed Mar. 14, 2014.

Notice of Allowance dated Mar. 26, 2016, U.S. Appl. No. 14/210,061, filed Mar. 14, 2014.

Office Action dated Sep. 26, 2017, U.S. Appl. No. 15/019,5708, filed Feb. 6, 2016.

Notice of Allowance dated May 18, 2018, U.S. Appl. No. 15/019,5708, filed Feb. 6, 2016.

Foreign Communication from a Related Counterpart—International Search Report and Written Opinion, dated Aug. 24, 2016, PCT/US2016/013687 , filed on Jan. 15, 2016.

Foreign Communication from a Related Counterpart—International Preliminary Examination Report, dated Jul. 19, 2018, PCT/US2016/013687 , filed on Jan. 15, 2016.

International Application No. PCT/US02/16311, International Preliminary Examination Report, dated Feb. 19, 2003, 6 pages.

Foreign Communication from a Related Counterpart—International Search Report and Written Opinion, dated Feb. 16, 2005, PCT/US2004/032788, filed on Oct. 5, 2004.

Foreign Communication from a Related Counterpart—International Preliminary Report on Patentability, dated Feb. 27, 2006, PCT/US2004/032788, filed on Oct. 5, 2004.

International Application No. PCT/US08/09736, Written Opinion of the International Searching Authority, dated Nov. 3, 2008, 5 pages.

International Application No. PCT/US08/09736, International Preliminary Report on Patentability, dated May 25, 2010, 6 pages.

Foreign Communication from a Related Counterpart—International Search Report and Written Opinion, dated Apr. 18, 2012, PCT/2011/065140, filed on Dec. 15, 2011.

Foreign Communication from a Related Counterpart—International Preliminary Report on Patentability, dated Jun. 25, 2013, PCT/2011/065140, filed on Dec. 15, 2011.

Foreign Communication from a Related Counterpart—International Search Report and Written Opinion, dated Jul. 21, 2013, PCT/US2012/043332, filed Jun. 20, 2012.

Foreign Communication from a Related Counterpart—International Preliminary Report on Patentability, dated Jan. 4, 2015, PCT/US2012/043332, filed Jun. 20, 2012.

Foreign Communication from a Related Counterpart—International Search Report and Written Opinion, dated Jan. 14, 2014, PCT/US2013/060971, filed Sep. 20, 2013.

Foreign Communication from a Related Counterpart—International Preliminary Report on Patentability, dated Jan. 1, 2015, PCT/US2013/060971, filed Sep. 20, 2013.

(56) References Cited

OTHER PUBLICATIONS

Foreign Communication from a Related Counterpart—International Search Report and Written Opinion, dated Jul. 1, 2016, PCT/US2016/017190, filed Feb. 6, 2016.
Foreign Communication from a Related Counterpart—International Preliminary Report on Patentability, dated Aug. 24, 2017, PCT/US2016/017190, filed Feb. 6, 2016.
Foreign Communication from a Related Counterpart—International Search Report and Written Opinion, dated Jul. 7, 2014, PCT/US2014/026655, filed on Mar. 14, 2014.
Foreign Communication from a Related Counterpart—International Preliminary Report on Patentability, dated Sep. 15, 2015, PCT/US2014/026655, filed on Mar. 14, 2014.
Foreign Communication from a Related Counterpart—International Search Report and Written Opinion, dated May 1, 2018, PCT/US2017/057674, filed on Oct. 20, 2017.
Foreign Communication from a Related Counterpart—International Search Report and Written Opinion, dated Jul. 23, 2018, PCT/US2018/033875, filed on May 22, 2018.
Mak, John, "Ethane Recovery or Ethane Rejection Operation," filed May 24, 2018, U.S. Appl. No. 15/988,310.
Mak, John, "Flexible NGL Recovery and Methods," filed Oct. 20, 2003, U.S. Appl. No. 60/516,120.
Mak, John, "Ethane Recovery and Ethane Rejection Methods and Configurations," filed Dec. 23, 2010, U.S. Appl. No. 61/426,756.
Mak, John, "Ethane Recovery and Ethane Rejection Methods and Configurations," filed Jan. 21, 2011, U.S. Appl. No. 61/434,887.
Mak, John, "Configurations and Methods for Retrofitting NGL Recovery Plant," filed Jun. 20, 2011, U.S. Appl. No. 61/499,033.
Mak, John, "Flexible NGL Recovery Methods and Configurations," filed Mar. 14, 2013, U.S. Appl. No. 61/785,329.
Mak, John, "Methods and Configuration of an NGL Recovery Process for Low Pressure Rich Feed Gas," filed Feb. 9, 2015, U.S. Appl. No. 62/113,938.
Mak, John, "Phase Implementation of Natural Gas Liquid Recovery Plants," filed Oct. 20, 2017, U.S. Appl. No. 15/789,463.
Mak, John, "Phase Implementation of Natural Gas Liquid Recovery Plants," filed Oct. 20, 2017, International Application No. PCT/US2017/057674.
Mak, John, et al., "Integrated Methods and Configurations for Ethane Rejection and Ethane Recovery," filed May 22, 2018, Application No. PCT/US2018/033875.
Restriction Requirement dated May 12, 2017, U.S. Appl. No. 14/988,388, filed Jan. 5, 2016.
Office Action dated Aug. 10, 2017, U.S. Appl. No. 14/988,388, filed Jan. 5, 2016.
Final Office Action dated Nov. 29, 2017, U.S. Appl. No. 14/988,388, filed Jan. 5, 2016.
Notice of Allowance dated Feb. 16, 2018, U.S. Appl. No. 14/988,388, filed Jan. 5, 2016.
U.S. Appl. No. 10/469,456, Office Action, dated Sep. 19, 2005, 6 pages.
U.S. Appl. No. 10/469,456, Notice of Allowance, dated Jan. 10, 2006, 6 pages.
Europe Patent Application No. 02731911.0, Supplementary European Search Report, dated Nov. 24, 2005, 3 pages.
Europe Patent Application No. 02731911.0, Examination Report, dated Mar. 2, 2006, 5 pages.
Europe Patent Application No. 02731911.0, Examination Report, dated Sep. 19, 2006, 4 pages.
Europe Patent Application No. 02731911.0, Intention to Grant, dated Aug. 1, 2007, 20 pages.
Europe Patent Application No. 02731911.0, Decision to Grant, dated Dec. 13, 2007, 2 pages.
Canada Patent Application No. 2484085, Examination Report, dated Jan. 16, 2007, 3 pages.
First Office Action dated Dec. 14, 2007, CN Application No. 200480039552.8 filed Oct. 30, 2003.
Second Office Action dated Nov. 7, 2008, CN Application No. 200480039552.8 filed Oct. 30, 2003.
Notice of Decision to Grant dated Jul. 31, 2009, CN Application No. 200480039552.8 filed Oct. 30, 2003.
Examination Report dated Dec. 19, 2012, EP Application No. 04794213.1 filed Oct. 4, 2004.
Second Examination Report dated Oct. 7, 2014, EP Application No. 04794213.1, filed Oct. 4, 2004.
Office Action dated Jan. 7, 2009, JP Application No. 2006538016, priority date Oct. 30, 2003.
Decision to Grant dated Aug. 20, 2010, JP Application No. 2006538016, priority date Oct. 30, 2003.
Office Action dated Aug. 4, 2010, U.S. Appl. No. 10/595,528, filed Feb. 28, 2007.
Final Office Action dated Dec. 29, 2010, U.S. Appl. No. 10/595,528, filed Feb. 28, 2007.
Advisory Action dated Apr. 14, 2011, U.S. Appl. No. 10/595,528, filed Feb. 28, 2007.
Office Action dated Jun. 8, 2011, U.S. Appl. No. 10/595,528, filed Feb. 28, 2007.
Final Office Action dated Oct. 27, 2011, U.S. Appl. No. 10/595,528, filed Feb. 28, 2007.
Notice of Allowance dated Mar. 5, 2012, U.S. Appl. No. 10/595,528, filed Feb. 28, 2007.
Europe Patent Application No. 08795331.1, Communication pursuant to Rules 161 and 162 EPC, dated Mar. 24, 2010, 2 pages.
China Patent Application No. 200880103754.2, First Office Action, dated Mar. 27, 2012, 20 pages.
China Patent Application No. 200880103754.2, Second Office Action, dated Dec. 26, 2012, 21 pages.
China Patent Application No. 200880103754.2, Third Office Action, dated Jul. 22, 2013, 7 pages.
China Patent Application No. 200880103754.2, Notification to Grant Patent Right for Invention, dated Dec. 23, 2013, 2 pages.
Australia Patent Application No. 2008287322, First Examination Report, dated Apr. 8, 2011, 2 pages.
Australia Patent Application No. 2008287322, Notice of Acceptance, dated Apr. 4, 2012, 1 pages.
Gulf Cooperation Council Patent Application No. GCC/P/2008/11533, Examination Report, dated Dec. 19, 2013, 4 pages.
Canada Patent Application No. 2694149, Office Action, dated Apr. 16, 2012, 2 pages.
U.S. Appl. No. 12/669,025, Office Action, dated May 8, 2012, 12 pages.
U.S. Appl. No. 12/669,025, Office Action, dated Oct. 10, 2013, 11 pages.
U.S. Appl. No. 12/669,025, Final Office Action, dated Mar. 4, 2014, 10 pages.
U.S. Appl. No. 12/669,025, Notice of Allowance, dated Apr. 7, 2015, 12 pages.
Mexico Patent Application No. MX/a/2010/001472, Office Action, dated Nov. 15, 2013, 1 page.
Mexico Patent Application No. MX/a/2010/001472, Office Action, dated Jul. 23, 2014, 1 page.
United Arab Emirates Patent Application No. 0143/2010, Search Report, dated Oct. 3, 2015, 9 pages.
Restriction Requirement dated Sep. 22, 2015, U.S. Appl. No. 13/996,805, filed Sep. 17, 2013.
Office Action dated Feb. 9, 2016, U.S. Appl. No. 13/996,805, filed Sep. 17, 2013.
Notice of Allowance dated Jun. 9, 2016, U.S. Appl. No. 13/996,805, filed Sep. 17, 2013.
Australian Application No. 2011349713, Examination Report, dated Dec. 16, 2014, 2 pages.
Australia Application No. 2011349713, Notice of Acceptance, dated Mar. 31, 2015, 2 pages.
Restriction Requirement dated Jan. 8, 2014, U.S. Appl. No. 13/528,332, filed Jun. 20, 2012.
Notice of Allowance dated Aug. 15, 2014, U.S. Appl. No. 13/528,332, filed Jun. 20, 2012.
Examination Report dated Mar. 17, 2016, AU Application No. 2012273028, priority date Jun. 20, 2011.
Office Action dated Jun. 28, 2018, CA Application No. 2,839,132, filed on Dec. 11, 2013.

(56) References Cited

OTHER PUBLICATIONS

Restriction Requirement dated Sep. 12, 2018, U.S. Appl. No. 15/259,354, filed Sep. 8, 2016.
Notice of Allowance dated Oct. 18, 2018, MX Application No. MX/a/20131014864, filed on Dec. 13, 2013.
Final Office Action dated Oct. 17, 2018, U.S. Appl. No. 14/033,096, filed Sep. 20, 2013.
Office Action dated Aug. 11, 2017, U.S. Appl. No. 15/191,251, filed Jun. 23, 2016.
Final Office Action dated Feb. 1, 2018,U.S. Appl. No. 15/191,251, filed Jun. 23, 2016.
Advisory Action dated Apr. 23, 2018, U.S. Appl. No. 15/191,251, filed Jun. 23, 2016.
Office Action dated Aug. 15, 2018, U.S. Appl. No. 15/191,251, filed Jun. 23, 2016.
European Patent Application No. 16884122.9, Communication pursuant to Rules 161 and 162 EPC, dated Aug. 20, 2018, 3 pages.
Foreign Communication from a Related Counterpart—International Preliminary Report on Patentability, dated Nov. 29, 2018, PCT/US2016/034362, filed on May 26, 2016.
International Search Report and Written Opinion, dated Dec. 12, 2017, International Application No. PCT/US2017/0050636, filed Sep. 8, 2017.
International Preliminary Report on Patentability, dated Mar. 21, 2019, PCT/US2017/0050636, filed Sep. 8, 2017.
Mak, John et al., "Methods and Configuration for Retrofitting NGL Plant for High Ethane Recovery." filed Sep. 3, 2016, U.S. Appl. No. 62/385,748.
Mak, John et al., "Methods and Configuration for Retrofitting NGL Plant for High Ethane Recovery." filed Sep. 3, 2016, U.S. Appl. No. 62/489,234.
Office Action dated Mar. 1, 2019, U.S. Appl. No. 15/259,354, filed Sep. 8, 2016.
Area 4, "Reboilers", found at: https://www.area4.info/Area4%20Informations/REBOILERS.htm.
Final Office Action dated Mar. 6, 2019, U.S. Appl. No. 15/191,251, filed Jun. 23, 2016.
Office Action dated Mar. 21, 2019, Canadian Patent Application No. 2976071.
Mak, John, "Configurations and Methods for NGL Recovery for High Nitrogen Content Feed Gases," filed Jan. 29, 2019, U.S. Appl. No. 16/260,288.
Mak, John et al., "Methods and Configuration for Retrofitting NGL Plant for High Ethane Recovery." filed Feb. 14, 2019, U.S. Appl. No. 15/325,696.

* cited by examiner

Table 1 - Stream Compositions

| Stream Mole % | Stream 101 Feed Gas | Stream 152 LPG Product | Stream 103 Feed to Ethane Recovery | Stream 186 Ethane Product | Stream 185 Feed to LNG Unit | Stream 212 LNG Product |
|---|---|---|---|---|---|---|
| Nitrogen | 1915 | 0.000 | 2.216 | 0.000 | 2.908 | 1.377 |
| Methane | 61.670 | 0.000 | 71.369 | 0.125 | 93.640 | 94.993 |
| Ethane | 22.860 | 1.615 | 26.263 | 99.243 | 3.450 | 3.626 |
| Propane | 10.134 | 73.397 | 0.151 | 0.626 | 0.003 | 0.003 |
| i-Butane | 0.814 | 5.943 | 0.001 | 0.003 | 0.000 | 0.000 |
| n-Butane | 2.109 | 15.401 | 0.001 | 0.002 | 0.000 | 0.000 |
| i-Pentane | 0.193 | 1.409 | 0.000 | 0.000 | 0.000 | 0.000 |
| n-Pentane | 0.239 | 1.749 | 0.000 | 0.000 | 0.000 | 0.000 |
| n-Hexane | 0.052 | 0.381 | 0.000 | 0.000 | 0.000 | 0.000 |
| n-Heptane | 0.013 | 0.092 | 0.000 | 0.000 | 0.000 | 0.000 |
| n-Octane | 0.002 | 0.013 | 0.000 | 0.000 | 0.000 | 0.000 |
| Gas Flow, MMSCFD | 77.48 | 10.61 | 67.01 | 15.96 | 51.05 | 48.56 |
| Pressure, psia | 472 | 483 | 1,200 | 1,205 | 905 | 17 |
| Temperature, °F | 80 | 145 | 231 | 57 | 96 | -261.5 |
| Ton per day | 2,213 | 609 | 1,608 | 576 | 1,032 | 972 |

*FIG. 5*

SYSTEMS AND METHODS FOR LNG PRODUCTION WITH PROPANE AND ETHANE RECOVERY

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

Hydrocarbon drilling and production systems can include the extraction of natural gas from wellbores in subterranean earthen formations. For ease of transport or storage, the natural gas can be liquefied. The liquefaction process includes condensing the natural gas into a liquid by cooling. The liquefied natural gas (LNG) can then be moved and stored more efficiently. Prior to condensing, the natural gas can be treated or processed to remove certain components such as water, dust, helium, mercury, acid gases such as hydrogen sulfide and carbon dioxide, heavy hydrocarbons, and other components.

Natural gas streams may contain methane, ethane, propane, and heavier hydrocarbons together with minor portions of hydrogen sulfide and carbon dioxide. A particular gas composition may include 85% to 95% methane and 3% to 8% ethane with the balance being propane and heavier hydrocarbons. The ethane plus liquid content of such a gas ranges from 2 to 5 GPM (gallons of ethane liquid per thousand standard cubic feet of gas) and is generally considered or identified as a "lean gas." However, certain natural gas streams include different compositions. Shale gas, for example, may be "richer" than the "lean gas" noted above, with ethane content ranging from 12% to 23%, ethane plus liquid content of 5 to 11 GPM, and heating values from 1,200 to 1,460 Btu/scf. Such an ethane-rich natural gas stream is generally considered or identified as a "wet gas." It is noted that a "wet gas" may also refer to a gas composition having a relatively high concentration of components heavier than methane.

It is often necessary for the hydrocarbon liquid content in a wet gas or shale gas stream to be removed to meet pipeline gas heating value specifications. In some cases, a hydrocarbon dewpointing unit using refrigeration cooling is used to remove the hydrocarbon liquid content. However, in some cases, the hydrocarbon dewpointing unit may not be sufficient to meet the pipeline gas heating value specifications. For example, with a wet gas or shale gas, the high heating value of the ethane content may exceed the pipeline gas heating value specifications. Accordingly, a natural gas liquid (NGL) recovery unit is needed to remove the hydrocarbon liquids. In some cases, the NGL contents captured by a NGL recovery unit provide economic value. In other cases, a natural gas where the non-methane component is limited can provide an economic value, such as for vehicle fuels.

Many feed gases are provided to the NGL recovery system at relatively high pressure, such as 900 psig or higher, for example. Such an NGL recovery system includes an expander to expand the lean feed gas to a lower pressure, such as 450 psig, for example, for feeding into the fractionation columns. However, a wet or rich shale gas is initially provided at low pressure.

SUMMARY

An embodiment of a LNG liquefaction plant includes a propane recovery unit including an inlet for a feed gas, which may be chilled, a first outlet for a LPG, and a second outlet for an ethane-rich feed gas, an ethane recovery unit including an inlet coupled to the second outlet for the ethane-rich feed gas, a first outlet for an ethane liquid, and a second outlet for a methane-rich feed gas, and a LNG liquefaction unit including an inlet coupled to the second outlet for the methane-rich feed gas, a refrigerant to cool the methane-rich feed gas, and an outlet for a LNG. The propane recovery unit may include a stripper, an absorber, and a separator configured to separate the chilled feed gas into a liquid that is directed to the stripper and a vapor that is directed to the absorber and is fractionated. The chilled stripper liquid may be converted to an overhead stream used as a reflux stream to the absorber. In some embodiments, the LNG liquefaction plant further includes a pump, a chiller, and a letdown valve, wherein the pump is configured to pump an absorber bottom liquid to the stripper, wherein the converted overhead stream is an ethane-rich overhead stream, and wherein the chiller is configured to chill the ethane-rich overhead stream and the letdown valve is configured to let down pressure in the ethane-rich overhead stream to thereby provide a two-phase reflux to the absorber. In certain embodiments, the stripper is a non-refluxed stripper.

In some embodiments, the overhead stream is directed to the absorber for cooling and reflux in the absorber to recover propane from the chilled feed gas without turbo-expansion. The stripper may operate at least 30 psi higher than the absorber, such that the stripper overhead stream generates Joule Thomson cooling to reflux the absorber. In some embodiments, about 99% of the propane content of the chilled feed gas is recovered as the LPG. In certain embodiments, the ethane recovery unit further includes a compressor to compress the ethane-rich feed gas and is configured to split the ethane-rich feed gas into first and second portions. The ethane recovery unit may further include a chiller to chill the first ethane-rich portion and an expander to expand the first ethane-rich portion prior to entering a demethanizer. At least one of the second ethane-rich portion and a first portion of a high pressure residue gas from the demethanizer may be directed as a reflux stream to the demethanizer. About 90% of the ethane content of the ethane-rich feed gas may be recovered as the ethane liquid. The LNG liquefaction unit may be configured to use the refrigerant to cool and condense the methane-rich feed gas to form the LNG with about 95% purity methane.

In some embodiments, the LNG liquefaction plant includes co-production of the LPG and the ethane liquid from a rich low pressure shale gas. The rich low pressure shale gas can be supplied at about 400 to 600 psig. The rich low pressure shale gas may include about 50 to 80% methane, about 10 to 30% ethane, a remaining component including propane and heavier hydrocarbons, and a liquid content of 5 to 12 GPM. The feed gas may be pre-treated to remove carbon dioxide and mercury, and dried in a molecular sieve unit.

An embodiment for a method for LNG liquefaction includes providing a rich low pressure shale gas to a propane recovery unit, converting the rich low pressure shale gas, in the propane recovery unit, to a LPG and an ethane-rich feed gas, converting the ethane-rich feed gas, in an ethane recovery unit, to an ethane liquid and a methane-rich feed gas, and converting the methane-rich feed gas, in a LNG liquefaction unit, to a LNG using a refrigerant. The method may further include separating the rich low pressure shale gas into a liquid that is directed to a stripper and a vapor that is directed to an absorber and is fractionated, converting the stripper liquid to an overhead stream, and providing the overhead stream as a reflux stream to the absorber.

BRIEF DESCRIPTION OF THE DRAWINGS AND TABLES

For a detailed description of exemplary embodiments, reference will now be made to the accompanying drawings and tables in which:

FIG. 5 illustrates Table 1 having stream compositions for the LNG liquefaction plant of FIG. 1.

DETAILED DESCRIPTION

Figure 1:
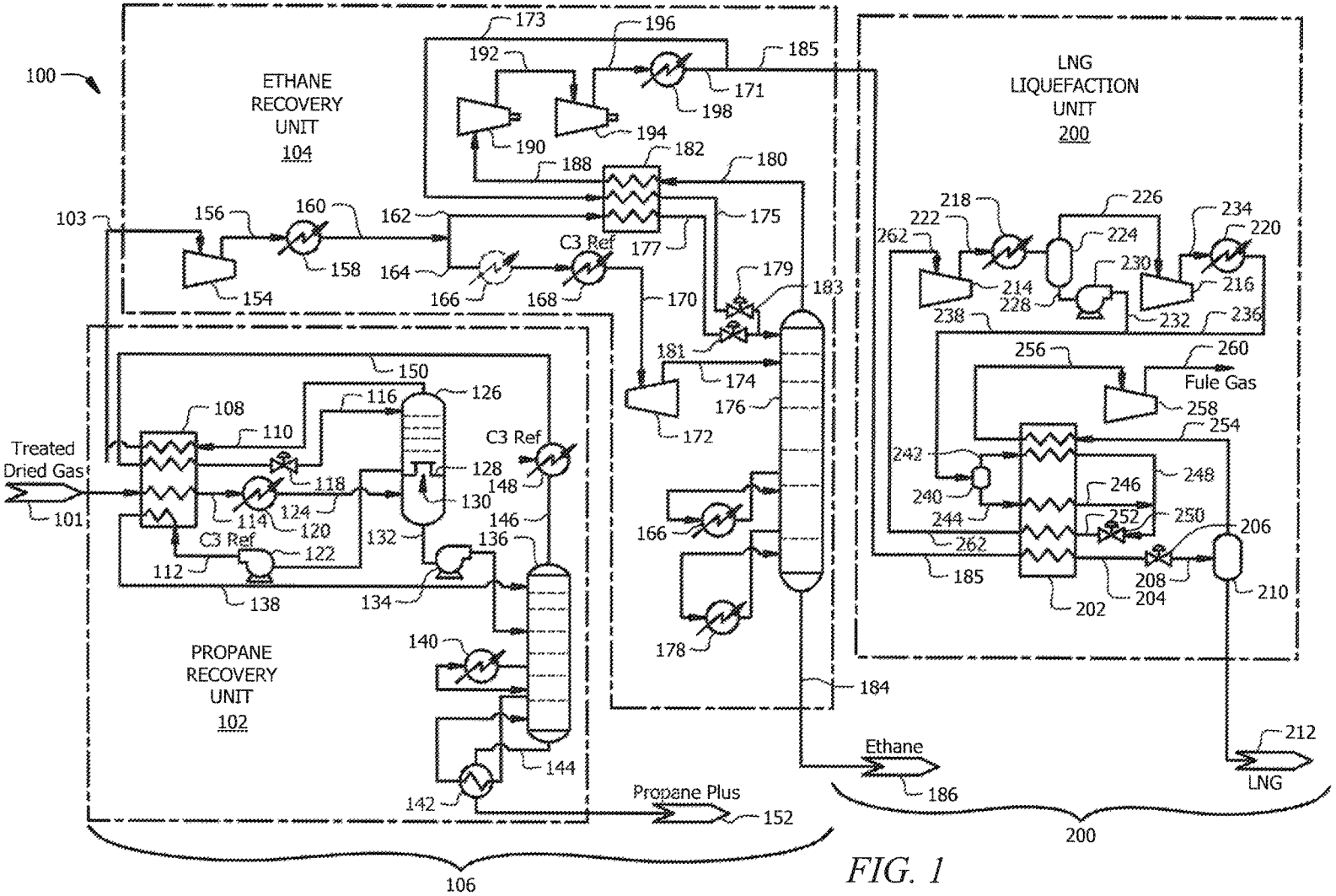
FIG. 1 is an equipment and process flow diagram for an embodiment of a LNG liquefaction plant or system in accordance with principles disclosed herein.

In the drawings and description that follow, like parts are typically marked throughout the specification and drawings with the same reference numerals. The drawing figures are not necessarily to scale. Certain features of the disclosed embodiments may be shown exaggerated in scale or in somewhat schematic form and some details of conventional elements may not be shown in the interest of clarity and conciseness. The present disclosure is susceptible to embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed below may be employed separately or in any suitable combination to produce desired results.

Unless otherwise specified, in the following discussion and in the claims, the terms "including" and "comprising" are used in an open-ended fashion, and thus should be interpreted to mean "including, but not limited to . . . ". Any use of any form of the terms "connect", "engage", "couple", "attach", or any other term describing an interaction between elements is not meant to limit the interaction to direct interaction between the elements and may also include indirect interaction between the elements described. The various characteristics mentioned above, as well as other features and characteristics described in more detail below, will be readily apparent to those skilled in the art upon reading the following detailed description of the embodiments, and by referring to the accompanying drawings.

In various embodiments described below, a LNG liquefaction plant or system includes an NGL recovery unit. In some embodiments, the LNG liquefaction plant with NGL recovery is configured for processing shale gas. In some embodiments, the shale gas is a rich or wet shale gas. In still further embodiments, the shale gas is at a low pressure, relative to a leaner shale gas, when processed. These and other embodiments will be described in more detail below.

Referring to FIG. 1, a LNG liquefaction plant or system 100 includes a NGL recovery unit 106 and a LNG liquefaction unit 200. In some embodiments, the NGL recovery unit 106 includes a propane recovery unit 102 and an ethane recovery unit 104. The NGL recovery unit 106 includes an inlet or initial feed stream 101 fluidicly coupled to the propane recovery unit 102 at an exchanger 108. Also fluidicly coupled to the exchanger 108 is a conduit 110 including an overhead vapor stream, a conduit 112 including an absorber bottom stream, a conduit 114 including a cooled shale gas stream, a conduit 116 including an ethane enriched reflux stream, a conduit 138 including a heated bottom stream, a conduit 146 including a cooled stripper overhead stream, and a conduit 103 including an ethane rich feed stream. The conduit 112 includes a pump 122 and further couples to an absorber 126. The conduit 114 includes a chiller 120 to further cool the shale gas stream to a two phase stream 124 that is directed into the absorber 126. The conduit 116 includes a valve 118.

The absorber 126 includes a separator that is integrated in the bottom of the absorber 126. The absorber 126 further includes a chimney tray 128 that receives a flashed vapor stream 130. In some embodiments, trays or packing are used as the contacting devices in the absorber 126. The conduit 110 is fluidicly coupled to the absorber 126, as is a conduit 132. A pump 134 can be used to pump a flashed liquid stream in the conduit 132.

The conduit 132 is fluidicly coupled to a stripper 136, as is the conduit 138. A reboiler 140 and a reboiler 142 are fluidicly coupled to the stripper 136. A conduit 146 is coupled to the stripper 136 and includes an overhead stream. A chiller 148 is coupled into the conduit 146 and can cool the overhead stream into a stream 150 that is directed into the exchanger 108. A conduit 144 is fluidicly coupled to the stripper 136 to direct a liquid propane gas (LPG) stream 152 out of the propane recovery unit 102. In some embodiments, trays or packing are used as the contacting devices in the stripper 136.

The conduit 103 is fluidicly coupled to the ethane recovery unit 104 and directs the ethane rich feed stream into a compressor 154. The compressor 154 is fluidicly coupled to a conduit 156 to direct the compressed stream to an exchanger 158 that can cool the compressed stream into a cooled high pressure stream 160. The conduit 156 splits into a conduit 162 for carrying a demethanizer reflux stream and a conduit 164 for carrying a stream to a demethanizer reboiler 166 for cooling. Additionally, the conduit 164 includes a chiller 168 for further cooling into a stream 170. The conduit 164 is fluidicly coupled to an expander 172, which is in turn fluidicly coupled to a conduit 174 for directing a depressurized and cooled feed stream to a demethanizer 176. The demethanizer 176 is configured to fractionate the feed stream, with assistance from the reboiler 166 and a reboiler 178, into an ethane bottom liquid stream, or ethane liquid, 186 directed through a conduit 184 and a methane overhead vapor stream directed through a conduit 180.

The conduit 180 is fluidicly coupled between the demethanizer 176 and an exchanger 182 for carrying the overhead vapor stream to the exchanger 182. A conduit 188 is fluidicly coupled between the exchanger 182 and a compressor 190 for carrying a residue gas stream to the compressor 190. In some embodiments, the compressor 190 is driven by the expander 172. A conduit 192 is coupled between the compressor 190 and a compressor 194 to further compress the residue gas stream. A conduit 196 is coupled between the compressor 194 and a chiller or exchanger 198 which cools the residue gas stream in a conduit 171 before the cooled residue gas stream is directed into the LNG liquefaction unit feed stream conduit 185. A conduit 173 is also fluidicly coupled between the conduit 171 and the exchanger 182 for directing a portion of the high pressure residue gas stream back to the exchanger 182. As shown in FIG. 1, the demethanizer reflux stream conduit 162 is also fluidicly coupled to the exchanger 182. The streams in conduits 162, 173 are chilled and condensed in the exchanger 182 using the overhead vapor stream of the conduit 180, thereby providing two lean reflux streams in conduits 175, 177 that are directed through valves 179, 181 and combined in a conduit 183 that is fluidicly coupled to the demethanizer 176.

The feed stream conduit 185 fluidicly couples to the LNG liquefaction unit 200 at a heat exchanger cold box 202. In some embodiments, as will be detailed more fully below, the LNG liquefaction unit 200 cools, condenses, and subcools the feed stream using a single mixed refrigerant (SMR). In other embodiments, other mixed refrigerants, external refrigerants, or internal refrigerants may be used. In various embodiments, the particular composition of the working fluid in the liquefaction cycle is determined by the specific composition of the feed gas, the LNG product, and the desired liquefaction cycle pressures. In certain embodiments, a small or micro-sized LNG plant may include a gas expander cycle that uses nitrogen or methane, particularly for offshore applications where liquid hydrocarbons are to be minimized.

A conduit 204 fluidicly coupled to the exchanger cold box 202 carries a liquefied and subcooled LNG stream across a letdown valve 206 to expand the LNG stream. A conduit 208 is coupled between the letdown valve 206 and a LNG flashed tank 210 for storage of the LNG product prior to export to a customer via LNG outlet stream conduit 212.

The SMR cycle uses two compression stages, comprising a first compressor 214 and a second compressor 216, with intercoolers. The first stage compressor 214 receives an input stream 262 and discharges a compressed stream 222 that is cooled by a chiller 218 and separated in a separator 224, thereby producing a liquid to a conduit 228. The liquid in the conduit 228 is pumped by a pump 230 forming a stream 232 prior to entering the exchanger cold box 202 via a conduit 238. The second stage compressor 216 receives an outlet vapor stream 226 from the separator 224 and discharges a compressed stream 234 that is cooled by a chiller 220 and carried by a conduit 236 to mix with the stream 232. The mixed stream in the conduit 238 is further separated in a separator 240, thereby producing a vapor stream 242 and a liquid stream 244. Both of streams 242, 244 are cooled and condensed in the exchanger cold box 202, exiting the exchanger cold box 202 as streams 246, 248 that are then mixed prior to a letdown valve 250. The subcooled liquid stream is then let down in pressure in the valve 250 to form a stream 252, and chilled to form a stream 262 from the exchanger cold box 202 and which supplies the refrigeration duty to the feed gas and the mixed refrigerant circuit that includes the first and second stage compressors 214, 216.

A conduit 254 is coupled to the LNG flashed tank 210 for carrying a gas stream to the exchanger cold box 202. The gas stream passes through the exchanger cold box 202 into a conduit 256 that is coupled to a compressor 258 for compressing the gas stream into a fuel gas stream 260.

In operation, the LNG liquefaction plant 100 receives the initial gas feed stream 101 at the propane recovery unit 102 of the NGL recovery unit 106. In some embodiments, the initial feed stream 101 includes a shale gas, or a wet shale gas. In an exemplary embodiment, the stream includes a 77 MMscfd shale gas with the composition shown in the "Stream 101 Feed Gas" column of Table 1 in FIG. 5. In further embodiments, the shale gas is treated. For example, the shale gas can be treated for mercury removal, carbon dioxide removal, and/or dried with molecular sieves. The initial feed stream 101 is cooled in the exchanger 108 by the overhead vapor stream in the conduit 110 from the absorber 126, and by the absorber bottom stream in the conduit 112. In some embodiments, the initial feed stream 101 is cooled to about 10° F. to 30° F. to form the cooled shale gas stream in the conduit 114. The cooled shale gas stream is further cooled in the chiller 120, to form the two phase stream 124. In some embodiments, the stream is further cooled to about −23° F. to −36° F. The two phase stream 124 is separated in the absorber 126 into the flashed liquid stream and the flashed vapor stream. The flashed liquid stream is pumped through the conduit 132 by the pump 134 and into the stripper 136. The flashed vapor stream 130 enters the bottom of the absorber through the chimney tray 128, and its propane content is absorbed in the absorber 126 by the ethane enriched reflux stream coming from the conduit 116.

The absorber 126 produces a propane depleted overhead vapor stream in the conduit 110 and an ethane enriched bottom stream in the conduit 112, separated as described above by the separator and the chimney stray 128. In some embodiments, the bottom stream is enriched with about 50% to 70% ethane content. The ethane enriched bottom stream is pumped by the pump 134, heated in the exchanger 108, and then fed to the top of the stripper 136. In some embodiments, the propane depleted overhead stream is heated in the exchanger 108 to about 70° F., thereby forming the ethane rich feed stream in the conduit 103 prior to feeding the ethane recovery unit 104. Consequently, it is possible that the turbo-expander in conventional NGL processes is not required in certain embodiments of the present NGL recovery unit 106. Further properties of an exemplary ethane rich feed stream are shown in the "Stream 103 Feed to Ethane Recovery" column of Table 1 in FIG. 5.

The stripper 136, operating at a higher pressure than the absorber in certain embodiments, removes the ethane content using heat from the reboilers 140, 142, producing the LPG stream 152. In some embodiments, the vapor pressure of the LPG stream 152 is 200 psig or lower. In some embodiments, the LPG stream 152 contains about 2% to 6% ethane. Further properties of an exemplary LPG stream 152 are shown in the "Stream 152 LPG Product" column of Table 1 in FIG. 5. Consequently, the LPG product is a trackable product that can be safely transported via pipeline or trucks. The stripper 136 overhead stream in the conduit 146 is cooled by the propane chiller 148 to form the stream 150. In some embodiments, the stream 150 is cooled to about −33° F. to −36° F. The cooled stream 150 is further chilled in the exchanger 108. In some embodiments, the exchanger 108 chills the stream to about −40° F. to −45° F., or a lower temperature. Exchanger chilling occurs prior to a letdown in pressure, such as at the valve 118, that results in the lean reflux stream to the absorber 126. Consequently, the top of the stripper 136 refluxes the absorber 126 via the conduit 146, the stream 150, the exchanger 108, and finally the conduit 116 that delivers the ethane enriched reflux stream to the absorber 126.

The ethane rich feed stream in the conduit 103 is directed from the propane recovery unit 102 to the ethane recovery unit 104, and compressed in the compressor 154. In some embodiments, the stream is compressed to about 1,000 to 1,200 psig. The compressed stream in the conduit 156 is cooled in the exchanger 158 to form the cooled high pressure stream 160. The cooled high pressure stream 160 is split into two portions: the stream in the conduit 162 and the stream in the conduit 164. The conduit 164 stream is cooled in the demethanizer side reboiler 166 and by the propane chiller 168. In some embodiments, the conduit 164 stream is cooled to about −33° F. or lower. In certain embodiments, the flow in the conduit 164 is about 70% of the total flow in the conduit 156 of the cooled high pressure stream 160. The cooled stream 170 after the propane chiller 168 is let down in pressure in the expander 172. In some embodiments, the stream 170 is let down in pressure to about 350 to 450 psig and chilled to about −100° F. The conduit 174 is for directing the depressurized and cooled feed stream to the demethanizer 176.

The demethanizer 176 is refluxed with the cooled high pressure stream in the conduit 162 and with the high pressure residue gas stream in the conduit 173. In some embodiments, the stream in the conduit 173 is about 20% to 30% of the total flow in the conduit 171. Both streams in the conduits 162, 173 are separately chilled using the demethanizer overhead stream in the conduit 180 and condensed in the subcool exchanger 182, generating two lean reflux streams to the demethanizer 176. In some embodiments, the two lean reflux streams are chilled to about −100° F. The demethanizer 176 fractionates the feed stream in the conduit 174 into the ethane bottom liquid stream 186 and the methane overhead vapor stream directed through the conduit 180. Further properties of an exemplary ethane bottom liquid stream 186 are shown in the "Stream 186 Ethane Product" column of Table 1 in FIG. 5. The residue gas stream from the subcool exchanger 182 in the conduit 188 is compressed by the compressor 190 which is driven by the expander 172. The residue gas stream is then further compressed by the compressor 194, and chilled by the exchanger 198. In some embodiments, the residue gas stream is compressed to about 900 psig before entering the feed stream conduit 185 and being fed to the LNG liquefaction unit 200. Further properties of an exemplary residue gas stream in the feed stream conduit 185 are shown in the "Stream 185 Feed to LNG Unit" column of Table 1 in FIG. 5.

In some embodiments, the residue gas stream in the conduit 185 enters the heat exchanger cold box 202 of the LNG liquefaction unit 200 at a pressure of 870 psig and a temperature of 95° F., and is cooled, condensed, and subcooled using a single mixed refrigerant (SMR), for example. Various refrigerants can be used in other embodiments, such as other external refrigerants or internal refrigerants such as a boil off gas (BOG) generated from the LNG itself. The liquefied and subcooled LNG stream coming out of the cold box 202 in the conduit 204 is expanded across the letdown valve 206 to produce the LNG product stream in the conduit 208. In some embodiments, the liquefied and subcooled LNG stream in the conduit 204 is at a pressure of about 890 psig and a temperature of about −255° F. In some embodiments, the LNG product stream in the conduit 208 is at nearly atmospheric pressure (>1.0 psig) and further subcooled to about −263° F., and stored in the LNG flashed tank 210 for export to customers as the LNG stream in the conduit 212. Further properties of an exemplary LNG stream in the conduit 212 are shown in the "Stream 212 LNG Product" column of Table 1 in FIG. 5.

The SMR cycle uses two compression stages, including the first compressor 214 and the second compressor 216. The first stage compressor 214 discharge is cooled and separated in the separator 224, producing a liquid which is pumped by the pump 230 forming the stream 232 prior to entering the cold box 202. In some embodiments, the second stage compressor 216 discharges at about 570 psig and is mixed with the stream 232 and further separated in the separator 240 producing the vapor stream 242 and the liquid stream 244. Both streams are cooled and condensed, exiting the cold box 202 as the streams 246, 248 at, for example, −255° F. The subcooled liquid is then let down in pressure in the letdown valve 250 and chilled to, for example, −262° F. to form the stream 262 which supplies the refrigeration duty to the feed gas and the mixed refrigerant circuit.

Figure 2:
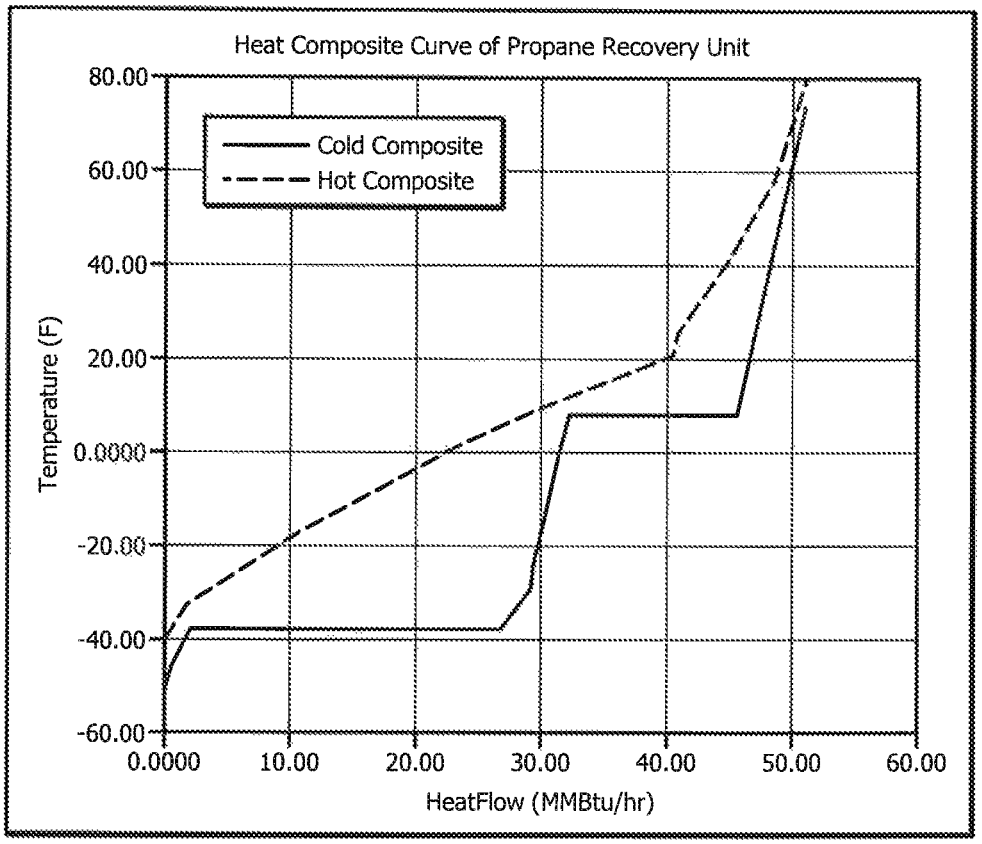
FIG. 2 is a heat composite curve for a propane recovery unit of the LNG liquefaction plant of FIG. 1.

In some embodiments, propane recovery of the disclosed systems and processes is 95%. In further embodiments, propane recovery is 99%. The efficiency of the propane recovery unit 102 is demonstrated by the temperature approaches in the heat composite curve in FIG. 2. The change in relationship between the hot composite curve and the cold composite curve from left to right over the HeatFlow axis shows the efficiency of the propane recovery unit 102. In some embodiments, the power consumption of the propane recovery unit 102 is driven by the propane chillers 120, 148, requiring about 7,300 HP. In some embodiments, LPG liquid production is about 7,200 BPD, or about 610 ton per day. In some embodiments, the specific power consumption for LPG production is about 8.9 kW/ton per day.

Figure 3:
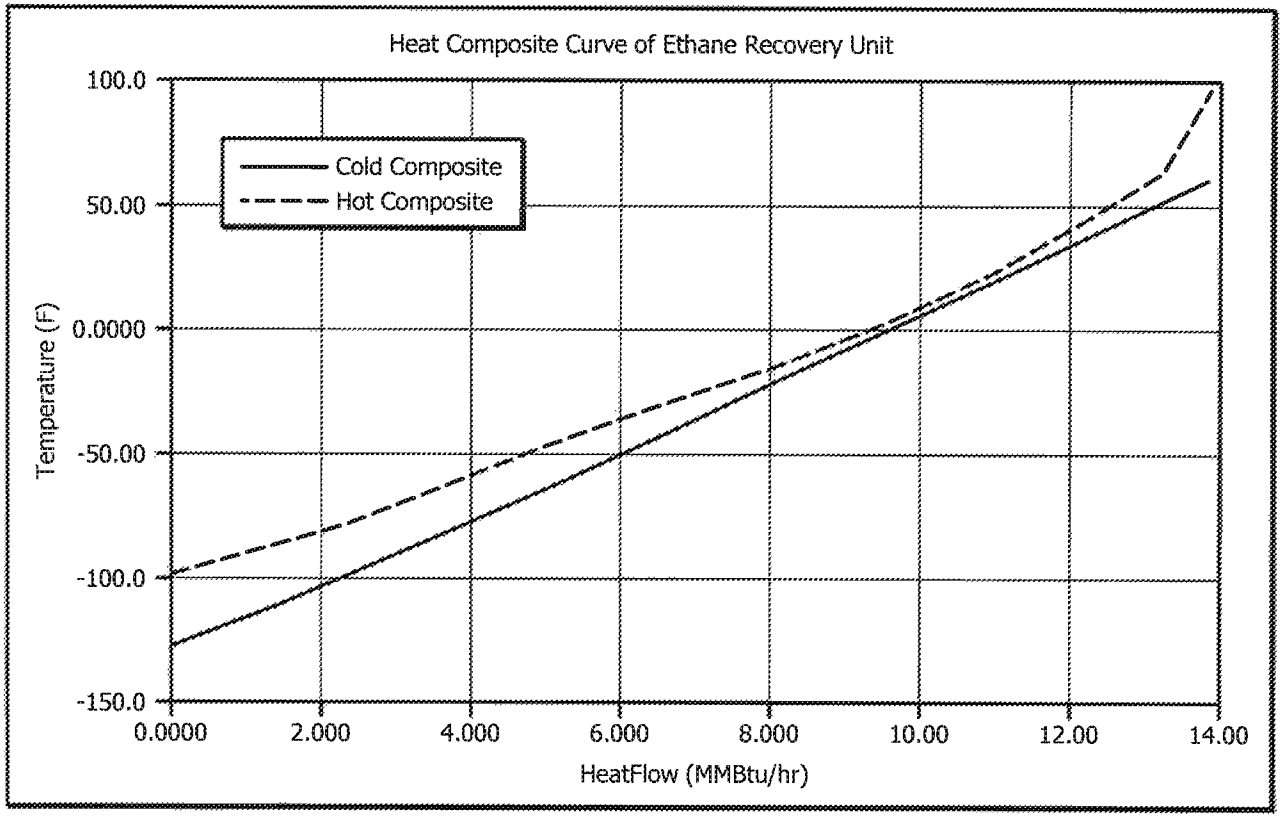
FIG. 3 is a heat composite curve for an ethane recovery unit of the LNG liquefaction plant of FIG. 1.

The efficiency of the ethane recovery unit 104 is demonstrated by the close temperature approaches in the heat composite curve in FIG. 3. The similar nature between the hot composite curve and the cold composite curve from left to right over the HeatFlow axis shows the efficiency of the ethane recovery unit 104. In some embodiments, the power consumption of the ethane recovery unit 104 is driven by the feed gas compressor 154, and the propane chiller 168, requiring about 9,000 HP. In some embodiments, ethane liquid production is about 10,000 BPD, or about 580 ton per day. In some embodiments, the specific power consumption to produce ethane is about 11.6 kW/ton per day.

Figure 4:
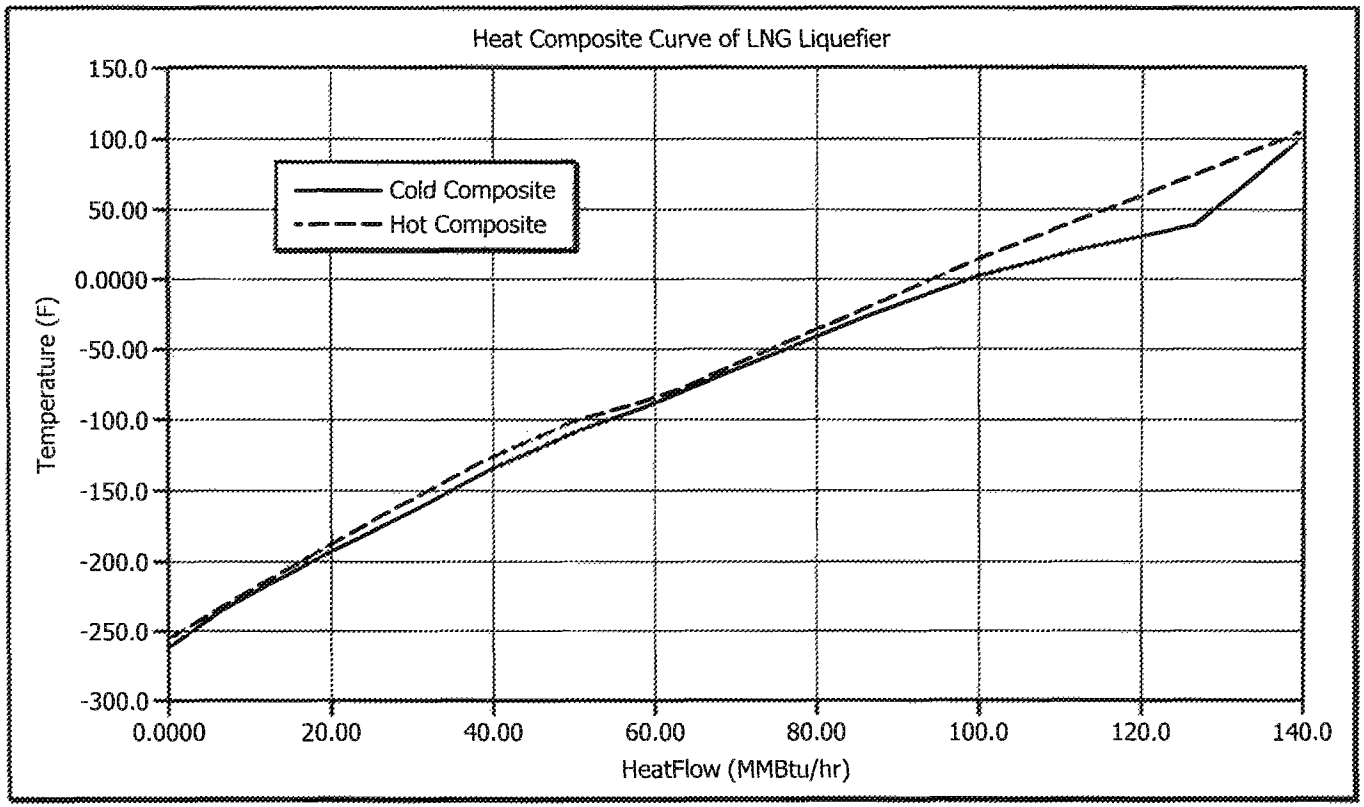
FIG. 4 is a heat composite curve for a LNG liquefaction unit of the LNG liquefaction plant of FIG. 1.

The efficiency of the LNG liquefaction unit 200 is demonstrated by the close temperature approaches in the heat composite curve in FIG. 4. The similar nature between the hot composite curve and the cold composite curve from left to right over the HeatFlow axis shows the efficiency of the LNG liquefaction unit 200. In some embodiments, the power consumption of the LNG liquefaction unit 200 is driven by the mixed refrigerant compressors 214, 216, requiring about 15,900 HP to produce 970 ton per day of LNG. In some embodiments, the specific power consumption for the LNG production is 12.2 kW/ton per day.

Thus, certain embodiments for LNG production are disclosed, with co-production of LPG and ethane in an efficient and compact process. In certain embodiments, wet or rich shale gas at low pressure can be converted to three liquid products: LPG, ethane liquid, and LNG. In some embodiments, the disclosed LNG liquefaction plant and process can recover 99% propane and 90% ethane while producing an LNG product with 95% methane purity. In some embodiments, the LNG liquefaction plant receives shale gas at a pressure of about 450 to 600 psig, or alternatively about 400 to 600 psig, with ethane plus liquid content of 5 to 12 GPM, and processes such a rich gas in three units: a propane recovery unit, an ethane recovery unit, and an LNG liquefaction unit. In certain embodiments, the propane recovery unit receives and processes the gas prior to the ethane recovery unit, and the ethane recovery unit receives and processes the gas prior to the LNG liquefaction unit. Consequently, propane, ethane, aromatics and other components desired to be removed from or minimized in the rich shale gas can be addressed according to the appropriate specifications for feeding into the LNG liquefaction unit, which can include other known LNG liquefaction units other than the embodiments described herein.

In certain embodiments, the propane recovery unit 102 includes brazed aluminum exchangers, propane chillers, an integrated separator-absorber and a non-refluxed stripper, wherein the separator provides a flashed vapor to the absorber, and a flashed liquid that is pumped, heated, and fed to a stripper. In some embodiments, the stripper does not require a condenser and reflux system. Liquid from the absorber bottom is pumped and fed to the non-refluxed stripper, which produces an ethane rich overhead that is chilled and let down in pressure to the absorber as a two-phase reflux. In some embodiments, the LNG liquefaction plant includes a high propane recovery process while processing a rich feed gas at low pressure, using the stripper overhead for cooling and reflux to recover propane from the feed gas, without turbo-expansion. In certain embodiments, propane recovery is about 99% propane recovery.

In some embodiments, the absorber operates between about 450 to 550 psig pressure. In further embodiments, the stripper operates at least 30 psi, alternatively at 50 psi, and alternatively at 100 psi or higher pressure than the absorber, such that the stripper overhead vapor can generate cooling using Joule Thomson cooling to reflux the absorber. Based on the feed gas composition shown in Table 1 in FIG. 5, in some embodiments, the absorber operates at about −45° F. to −65° F. in the overhead and about −40° F. to −60° F. in the bottom, while the stripper operates at about 10° F. to 20° F. in the overhead and about 150° F. to 250° F. in the bottom. In certain embodiments, these temperatures may vary and are dependent on the feed gas compositions.

In some embodiments, the propane recovery unit recovers 99% of the propane and heavier hydrocarbons, producing an LPG liquid product with a vapor pressure of about 200 psig or lower pressure and an overhead vapor depleted in the propane and heavier hydrocarbon components. In certain embodiments, such a LPG product is a truckable LPG product, and the absorber overhead vapor is depleted in propane, containing the methane and ethane hydrocarbons only.

In some embodiments, the ethane recovery unit includes gas compressors, brazed aluminum exchangers, propane chillers, turbo-expanders and a demethanizer. In some embodiments, the feed gas is compressed to about 900 to 1,200 psig or higher pressure, and the compressed gas is split into two portions with 70% chilled and expanded to feed the demethanizer while the remaining portion is liquefied in a subcool exchanger, forming a reflux to the demethanizer. In certain embodiments, the demethanizer operates at about 350 to 450 psig or higher pressure. In still further embodiments, a portion of the high pressure residue gas, for example, about 20% to 30%, is recycled back to the subcool exchanger and then to the demethanizer as another or second reflux stream. Subsequently, the ethane recovery unit produces a 99% purity ethane liquid and a residue gas with 95% methane content.

Finally, in some embodiments, the residue gas from the ethane recovery unit is liquefied using a multi-component refrigerant in brazed aluminum exchangers. In some embodiments, the multi-component refrigerant contains nitrogen, methane, ethane, propane, butane, pentane, hexane, and other hydrocarbons. In some embodiments, the mixed refrigerant is compressed to about 500 to 700 psig, cooled by an air cooler and condensed in the cold box prior to let down in pressure which generates cooling to subcool the high residue gas stream to about −250 to −260° F. The subcooled LNG is further let down in pressure to about atmospheric pressure, producing the LNG liquid product.

The above discussion is meant to be illustrative of the principles and various embodiments of the present disclosure. While certain embodiments have been shown and described, modifications thereof can be made by one skilled in the art without departing from the spirit and teachings of the disclosure. The embodiments described herein are exemplary only, and are not limiting. Accordingly, the scope of protection is not limited by the description set out above, but is only limited by the claims which follow, that scope including all equivalents of the subject matter of the claims.

What is claimed is:

1. A LNG liquefaction plant comprising:

a feed stream comprising methane, ethane, and propane;

a propane recovery unit configured to produce LPG and an ethane-rich feed gas from the feed stream;

an ethane recovery unit including:

a compressor configured to compress the ethane-rich feed gas to form a compressed stream, wherein the compressed stream is configured to split into a first portion and a second portion, wherein the first portion of the compressed stream, the second portion of the compressed stream, and the ethane-rich feed gas are each ethane-rich, wherein the compressed stream and the second portion of compressed stream have the same composition;

a demethanizer configured to produce an ethane liquid in an ethane bottom liquid stream and a residue gas in a methane overhead vapor stream, wherein a first portion of the residue gas is configured to flow to the demethanizer as a first reflux stream, wherein a second portion of the residue gas from the demethanizer is a methane-rich feed gas, wherein the first portion of the compressed stream is configured to flow to the demethanizer as a second reflux stream;

a first heat exchanger configured to heat the methane overhead vapor stream, cool the first portion of the residue gas, and cool the first portion of the compressed stream; and an expander configured to expand the second portion of the compressed stream prior to entering the demethanizer; and a LNG liquefaction unit configured to receive the methane-rich feed gas, cool the methane-rich feed gas with a refrigerant cycle, and recover LNG from the methane-rich feed gas.

2. The LNG liquefaction plant of claim 1, wherein the propane recovery unit comprises:

a second heat exchanger configured to cool the feed stream to form a cooled feed stream;

a chiller configured to chill the cooled feed stream to form a chilled feed gas;

an absorber configured to separate the chilled feed gas into an absorber bottom stream, a flashed liquid stream, and an absorber overhead vapor stream;

a stripper configured to receive the absorber bottom stream and the flashed liquid stream and to form a stripper overhead stream and a LPG stream containing the LPG, wherein the stripper overhead stream contains ethane and methane, wherein the second heat exchanger is further configured to heat the absorber overhead stream to form a heated absorber overhead stream, wherein the heated absorber overhead stream contains the ethane-rich feed gas.

3. The LNG liquefaction plant of claim 2, wherein the stripper overhead stream is configured to be an absorber reflux stream to the absorber, wherein the stripper is configured to receive the absorber bottom stream at a first location above a second location where the stripper receives the flashed liquid stream.

4. The LNG liquefaction plant of claim 3, wherein the propane recovery unit further comprises:

a first pump;

a second pump;

a second chiller; and a letdown valve, wherein the first pump is configured to pump the absorber bottom stream to the stripper, wherein the second pump is configured to pump the flashed liquid stream to the stripper, wherein the second chiller is configured to chill the stripper overhead stream, wherein the letdown valve is configured to let down in pressure the stripper overhead stream to thereby provide the absorber reflux stream as a two-phase reflux to the absorber.

5. The LNG liquefaction plant of claim 2, wherein the stripper is a non-refluxed stripper.

6. The LNG liquefaction plant of claim 3, wherein the stripper overhead stream is configured to be directed to the absorber as the absorber reflux stream for cooling and reflux in the absorber to recover propane from the chilled feed gas without turbo-expansion, wherein the stripper is configured to operate at least 30 psi higher than the absorber, such that the stripper overhead stream generates Joule Thomson cooling to reflux the absorber.

7. The LNG liquefaction plant of claim 3, wherein 99% of the propane content of the chilled feed gas is recovered as the LPG.

8. The LNG liquefaction plant of claim 1, wherein the first reflux stream and the second reflux stream combine to form a single reflux stream into a top of the demethanizer.

9. The LNG liquefaction plant of claim 1, wherein the ethane recovery unit further comprises a chiller configured to chill the second portion of the compressed stream utilizing propane refrigeration.

10. The LNG liquefaction plant of claim 9, wherein the first reflux stream and the second reflux stream are configured to flow to a top of the demethanizer at a first location above a second location where the second portion of the compressed stream enters the demethanizer.

11. The LNG liquefaction plant of claim 10, wherein 90% of the ethane content of the ethane-rich feed gas is recovered as the ethane liquid.

12. The LNG liquefaction plant of claim 1, wherein the refrigerant cycle is configured to cool and condense the methane-rich feed gas to form the LNG with 95% purity methane, wherein the refrigerant cycle comprises:

a first compressor configured to compress a single mixed refrigerant to form a first compressed stream;

a first separator configured to separate the first compressed stream into a first vapor stream and a first liquid stream;

a second compressor configured to receive and compress the first vapor stream to form a second compressed stream, wherein the second compressed stream and the first liquid stream are combined to form a mixed stream;

a second separator configured to separate the mixed stream into a second vapor stream and a second liquid stream;

an exchanger cold box configured to cool and condense the second vapor stream and the second liquid stream, wherein the second vapor stream and the second liquid stream are combined after exiting the exchanger cold box; and a let down valve configured to let down a pressure of a stream comprising the combined second vapor stream and second liquid stream to form a let-down stream, wherein the let-down stream is configured to flow through the exchanger cold box to provide refrigeration for the methane-rich feed gas.

13. The LNG liquefaction plant of claim 1, wherein the feed stream comprises a shale gas supplied at a pressure of 400 to 600 psig.

14. The LNG liquefaction plant of claim 1, wherein the feed stream further comprises heavier hydrocarbons.

15. The LNG liquefaction plant of claim 1, wherein the feed stream is pre-treated to remove carbon dioxide and mercury, and dried in a molecular sieve unit.

16. The LNG liquefaction plant of claim 2, wherein the absorber bottom stream comprises 50 to 70 mol % ethane.

17. The LNG liquefaction plant of claim 1, wherein the refrigerant cycle is configured to provide refrigeration only to the LNG liquefaction unit.

18. The LNG liquefaction plant of claim 1, wherein the feed stream comprises 50 to 80 mol % methane.

19. The LNG liquefaction plant of claim 18, wherein the feed stream further comprises 10 to 30 mol % ethane.

20. The LNG liquefaction plant of claim 1, wherein the feed stream has a liquid content of 5 to 12 GPM.

* * * * *